US011674272B2

(12) United States Patent
Yi

(10) Patent No.: US 11,674,272 B2
(45) Date of Patent: Jun. 13, 2023

(54) LOW-EMISSION HOT-IN-PLACE ASPHALT RECYCLING EQUIPMENT TRAIN SYSTEM

(71) Applicant: WTD Heat Technology Ltd., Mississauga (CA)

(72) Inventor: Weihong Yi, Mississauga (CA)

(73) Assignee: WTD HEAT TECHNOLOGY LTD., Toronto (CA)

( * ) Notice: Subject to any disclaimer, the term of this patent is extended or adjusted under 35 U.S.C. 154(b) by 212 days.

(21) Appl. No.: 17/234,497

(22) Filed: Apr. 19, 2021

(65) Prior Publication Data

US 2022/0333316 A1 Oct. 20, 2022

(51) Int. Cl.
*E01C 23/06* (2006.01)

(52) U.S. Cl.
CPC ..... *E01C 23/065* (2013.01)

(58) Field of Classification Search
CPC ..... E01C 23/065
USPC ..... 404/77, 79, 95, 75
See application file for complete search history.

(56) References Cited

U.S. PATENT DOCUMENTS 5,472,292 A * 12/1995 Wiley ..... E01C 23/065 404/90
5,484,224 A * 1/1996 Lynch ..... E01C 23/065 404/77
5,544,971 A * 8/1996 Huege ..... E01C 19/1004 404/91
5,653,552 A * 8/1997 Wiley ..... E01C 23/065 404/95
6,220,782 B1 * 4/2001 Yates ..... E01C 23/065 404/90
6,371,689 B1 * 4/2002 Wiley ..... E01C 23/065 404/95
6,416,249 B1 * 7/2002 Crupi ..... E01C 23/065 404/90
10,407,849 B1 * 9/2019 Matthews ..... E01C 19/002
2003/0026656 A1 * 2/2003 Crupi ..... E01C 23/065 404/77
2003/0194273 A1 * 10/2003 Lloyd ..... E01C 23/065 404/83
2010/0104363 A1 * 4/2010 Benedetti ..... E01C 23/065 404/113
2010/0209188 A1 * 8/2010 Wiley ..... E01C 23/065 404/77
2014/0015303 A1 * 1/2014 Denson ..... E01C 23/088 299/39.2
2014/0270953 A1 * 9/2014 Duffy ..... E01C 19/48 404/91
2015/0098760 A1 * 4/2015 Menzenbach ..... B05B 1/3046 404/75

(Continued)

*Primary Examiner* — Raymond W Addie
(74) *Attorney, Agent, or Firm* — Ridout & Maybee LLP

(57) ABSTRACT

A low-emission hot-in-place asphalt recycling equipment train system is disclosed, which comprises at least three heating units, a milling unit, a centralized hot mix heating unit, a mixing unit, and compatible paving and compacting units. The hot-in-place asphalt recycling equipment train system realizes stepwise uniform heating of pavements, recycling of heat energy, centralized treatment and discharge of fumes, centralized and uniform hot mix heating of materials without causing damage, simultaneous metering and feeding of required materials at multiple points, and on-site mobile batch mixing.

11 Claims, 12 Drawing Sheets

(56) References Cited

U.S. PATENT DOCUMENTS

| | | | | |
|---|---|---|---|---|
| 2015/0104255 | A1* | 4/2015 | Musil | E01C 23/088 404/128 |
| 2015/0139727 | A1* | 5/2015 | Filion | E01C 7/187 404/95 |
| 2019/0153681 | A1* | 5/2019 | Christian | E01C 11/005 |
| 2019/0292735 | A1* | 9/2019 | Coe | E01C 23/14 |
| 2020/0263366 | A1* | 8/2020 | Schlenker | B60G 17/017 |
| 2021/0071372 | A1* | 3/2021 | Cottingham | F23D 14/12 |

* cited by examiner

LOW-EMISSION HOT-IN-PLACE ASPHALT RECYCLING EQUIPMENT TRAIN SYSTEM

TECHNICAL FIELD

The invention involves the technical field of asphalt pavement maintenance. It relates to an asphalt regeneration paving system, and more particularly, to a low-emission hot-in-place asphalt recycling equipment train system.

BACKGROUND ART

The first asphalt roadway in North America was built in 1870. Now asphalt roads account for 90% of all roads in the United States and Canada. With the increasing transportation demand and traffic volume, some surface non-subgrade damage, such as ruts, potholes, raveling caused by oxidized asphalt, web-like cracks, surface cracks, water permeability of bonding layers, have occurred more frequently. Especially in some cold areas with heavy rainfall and snowfall in North America, the use of snow melting agents has shortened the service life of asphalt pavements. The hot-in-place asphalt recycling technology completely solves two major problems of traditional asphalt pavement construction methods: long road closure time and the difficulty of recovering asphalt pavement materials. The hot-in-place asphalt recycling technology has been available in North America for nearly 30 years, but it has not been fully and widely used so far. The main reason is that the equipment and heating technology of the traditional hot-in-place asphalt recycling equipment trains are backward, and the uniformity of construction quality and the service life of the recycled pavements cannot be guaranteed. In addition, organized emission of fumes generated after heating asphalt pavements cannot be realized when the traditional hot-in-place asphalt recycling technology is used, seriously impairing the environment around the construction sites and the health of the workers at the construction sites. The construction method does not meet the environmental protection requirements of various regions in North America.

Therefore, the development of low-emission hot-in-place asphalt recycling equipment is of great significance to reduce construction costs, protect the ecological environment and the highway construction in China. To develop suitable low-emission recycling equipment trains, more efforts should be made to strengthen the theoretical research of the asphalt recycling technology.

SUMMARY

The purpose of the invention is to propose a hot-in-place asphalt recycling equipment train system in view of the above-mentioned problems of the prior art. With a reasonable combination of five core competencies and equipment, the said hot-in-place asphalt recycling equipment train system realizes stepwise uniform heating of pavements, recycling of heat energy, centralized treatment and discharge of fumes, centralized and uniform hot mix heating of materials without causing damage, simultaneous metering and feeding of required materials at multiple points, and on-site mobile batch mixing.

The technical scheme of the invention is as follows:

In this low-emission hot-in-place asphalt recycling equipment system, the following factors should be considered for the configuration of heating units: firstly, ensure that the old road surface can be heated in a stepwise manner and the heating temperature can be controlled; secondly, ensure good economic benefits. In view of the aforesaid factors, generally three heating units are needed. A folding thermal preservation board with certain unfolding and folding length is arranged at the tail of the heating body of each heating unit. The heating system of the milling unit is the same as the heating system of the heating unit in terms of basic principle and structure. In addition, the heating system of the milling unit has the function of heating old road surfaces. Through the fume collecting hood and the fume extractor which can stretch out and draw back with the milling bit tools, the fumes generated during milling can be collected and sent into the heating furnace for treatment. The hot mix heating system of the centralized hot mix heating unit is the same as the heating system of the heating unit in terms of basic principle and structure. The hot mix heating system of the centralized hot mix heating unit uniformly raises the temperature of the mixture. The heat preservation system of the mixing unit is the same as the heating system of the heating unit in terms of basic principle and structure. The heat preservation system of the mixing unit heats and maintains the temperature of the entire material stack. The mixing tanks are batch mixers. The weighing bin can accurately weigh the mixture in each tank and can simultaneously measure and feed various additives.

Preferably, the bellows of the heating unit should comprise two parts: an air outlet area and a return air area. The air supply port of the combustion chamber is connected to the air outlet area, the air inlet of the fan of the heating unit is connected to the return air area, and the bellows of the heating unit has an open bottom.

Preferably, in the above-mentioned low-emission hot-in-place asphalt recycling equipment train system, an exhaust funnel should be installed at the top of the degradation chamber.

Preferably, in the above-mentioned low-emission hot-in-place asphalt recycling equipment train system, the milling bit tools should be in a spiral shape and should have flat edges. Bit tools with flat edges can mill pavements without causing damage and ensure that the gradations of pavement materials will not be affected. According to the principle of spiral distribution of milling bit tools, the loose old materials after milling can be collected at the tail to form a trapezoidal material stack.

Preferably, in the low-emission hot-in-place asphalt recycling equipment train system, a dust collector should be arranged between the air outlet of the fan of the heating unit and the hot mix heating chamber. The air inlet of the dust collector should be connected to the air outlet of the fan of the heating unit, and the air outlet of the dust collector should be connected to the hot mix heating chamber. The fine particles of the flying materials in the return air can be removed by the dust collector, so as to realize fumeless and dust-free centralized heating. Moreover, there should be additives to select as well as the function of secondary pavement milling.

Preferably, in the above-mentioned low-emission hot-in-place asphalt recycling equipment train system, the upender should have a shell. One end of the shell is a material inlet, and the other end is a material outlet. A plurality of boot-shaped mechanical turning devices should be evenly spaced in the shell along the same axis.

Preferably, in the above-mentioned low-emission hot-in-place asphalt recycling equipment train system, the upender should comprise a shell. One end of the shell should be a material inlet, the other end should be a material outlet, and a plurality of rollers should be evenly spaced in the shell along the same horizontal line to coordinate with the turning structure of the semi-blades.

Preferably, in the above-mentioned low-emission hot-in-place asphalt recycling equipment train system, the upender should comprise a shell. One end of the shell should be a material inlet, the other end should be a material outlet, and a plurality of rotating shafts should be evenly spaced in the shell along the same horizontal line to coordinate with the turning structures of turning rods and turning blades. All the three turning structures can turn up the materials to form a curtain, increasing the contact area between hot air and materials and improving heat exchange.

Preferably, in the low-emission hot-in-place asphalt recycling equipment train system, four spiral rods for material conveying should be arranged longitudinally in the weighing bin, baffle plates should be arranged above the spiral rods for material conveying, receiving plates should be arranged below the spiral rods for material conveying, an additive weighing device should be installed at the top of the weighing bin, and a plurality of doors should be at the bottom of the weighing bin. The built-in device for weighing and metering recycled materials and additives that is used for the mixing unit should be a weighing bin suspended on a four-point weighing sensor. The weighing sensor should have lateral buffer compensation and send high-frequency weighing signals to the controller. The upender should be suitable for in-vehicle application in scenarios of hot-in-place recycling construction.

Preferably, in the above-mentioned low-emission hot-in-place asphalt recycling equipment train system, at least one mixing paddle should be arranged in each mixing tank. With the mixing paddle in the mixing tank, all asphalt mixture can be mixed in a vortex in the mixing tank. Intense chemical reaction of asphalt mixture will happen. Mixing for a long time maximizes the effect of the additives, and then asphalt rejuvenators can fully and evenly recycle the old asphalt. Sufficient mixing time ensures the homogeneity of the recycled asphalt mixture. The mixing quality is comparable to that of mixing stations used in plants.

Compared with the prior art, the low-emission hot-in-place asphalt recycling equipment train system has the following beneficial effects:

A variety of damage of asphalt pavements can be repaired in an integrated manner. Old pavement materials and the fed required materials and additives are mixed, paved and rolled in situ by heating of hot air, hot milling, uniform hot mix heating and batch mixing technologies, so that the performance of asphalt pavements is fully restored. According to the concept of "clean production process, guaranteed recycling quality, and 100% high value-added utilization of old materials," relying on the five core competencies of "new heating mode, new heating principle, new design of hot mix heating, new mixing mode, and new intelligent system," the new hot-in-place asphalt recycling equipment train successfully realizes zero fume and dust overflow, centralized and harmless emission of waste gas during the construction. The production process and the quality of the mixture are comparable to those of plants, and recycled pavements are as reliable as new pavements in terms of performance and durability. The new hot-in-place asphalt recycling equipment train system not only lays a foundation for wide applications of recycled materials in practical projects, but also provides the optimum complete set of technologies for saving road materials and funds, avoiding environmental pollution, and realizing safe, fast, and eco-friendly road maintenance. This invention realizes centralized collection and treatment of the fume produced during heating process, and organized discharge of treated invisible fume. Comparing to the traditional hot-in-place unit, the invention provides cleaner construction process and better road quality with a simpler mechanical structure, which not only lowers manufacturing cost, but also reduces the complexity in operation, maintenance and repair.

Figure 1:
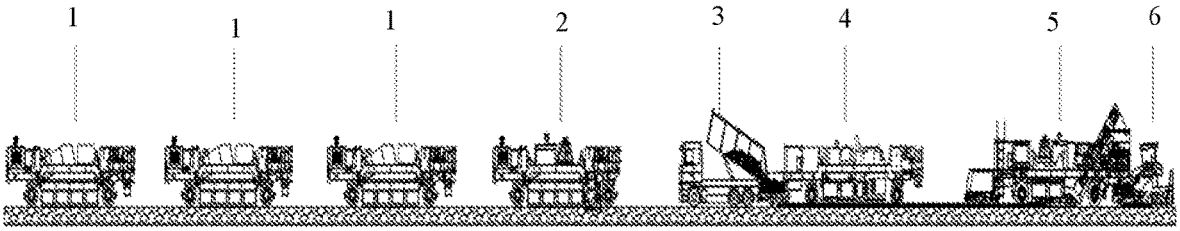
FIG. 1 is an overall view of the recycling equipment train system according to the invention.
Figure 2:
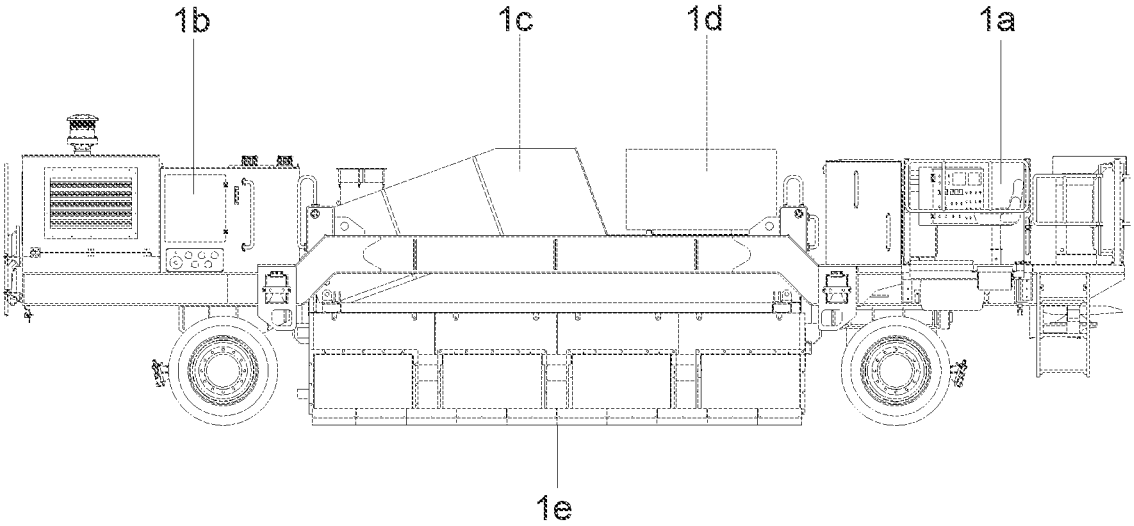
FIG. 2 is a structural diagram of a heating unit according to the invention.
Figure 3:
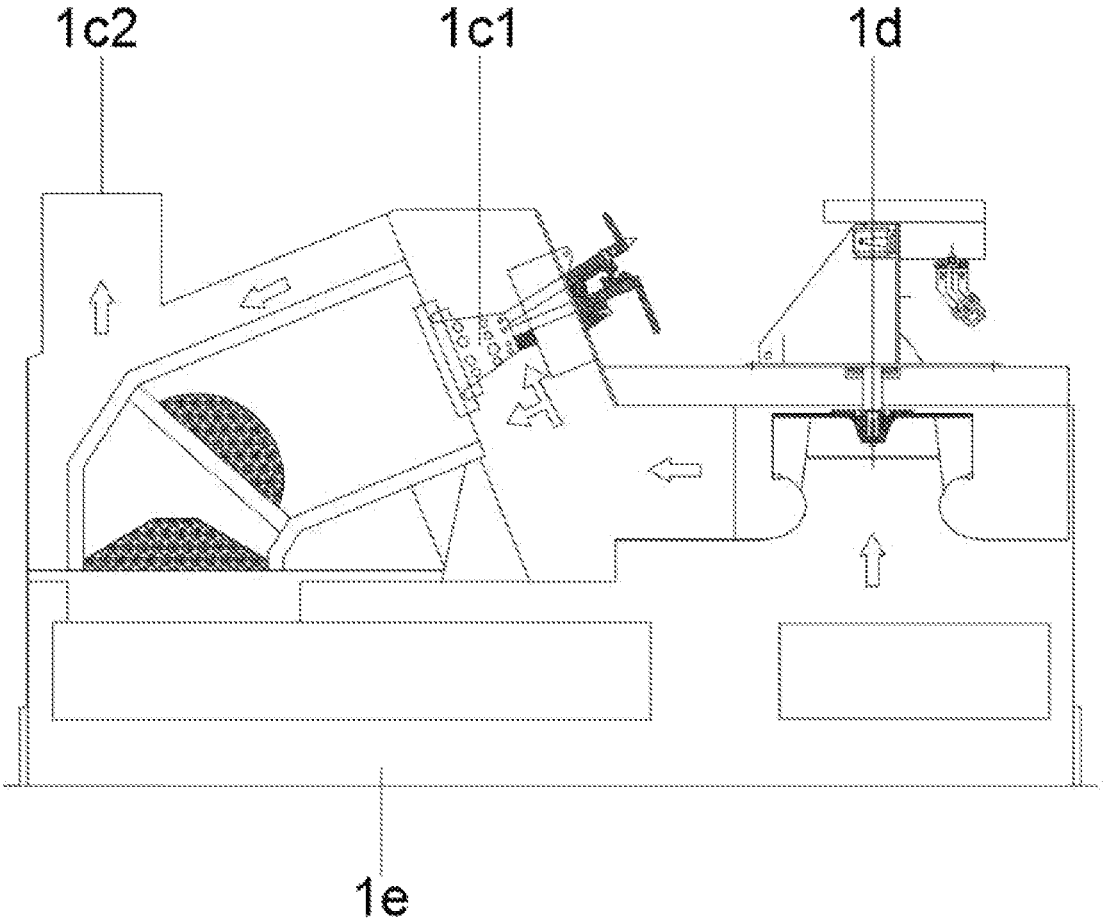
FIG. 3 is a schematic diagram of centralized fume collection and discharge at all heating systems according to the invention.
Figure 4:
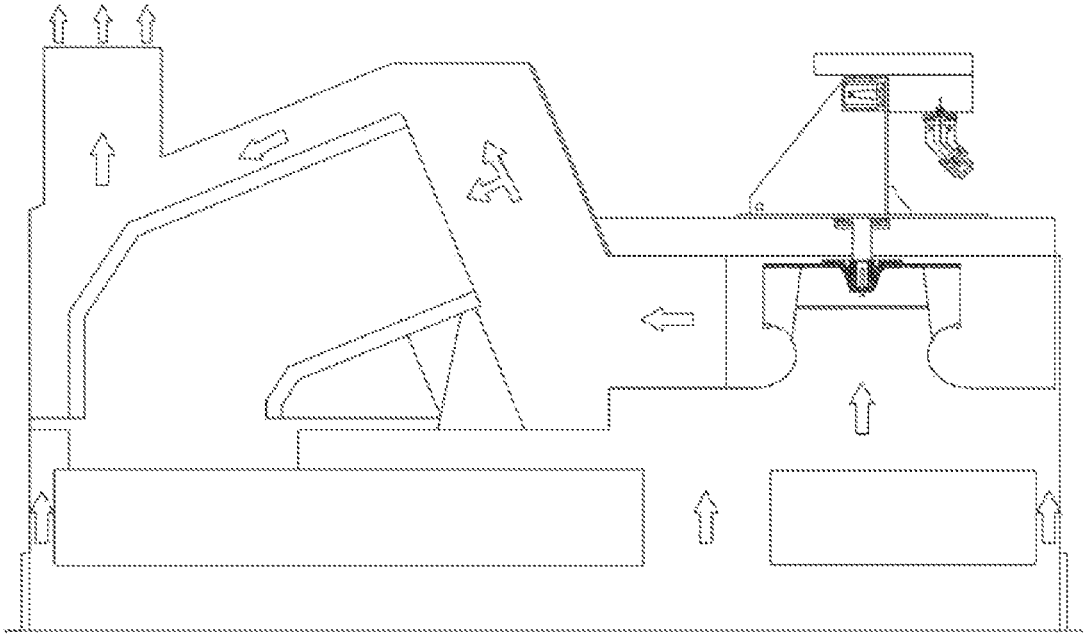
FIG. 4 is a schematic diagram of fume flow direction of centralized collection and discharge at all heating systems according to the invention.
Figure 5:
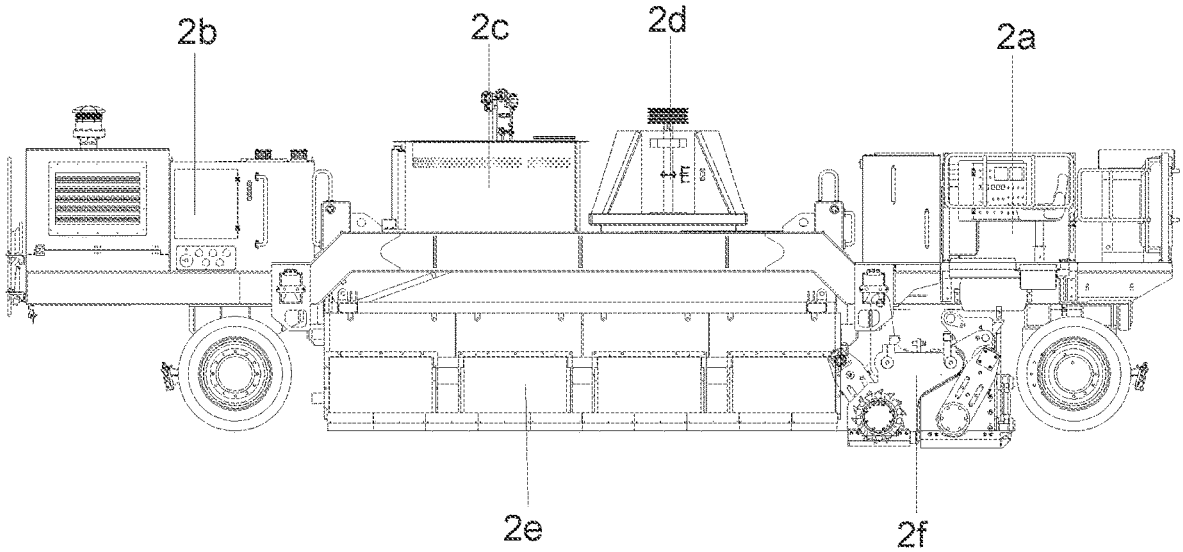
FIG. 5 is a structural diagram of a milling unit according to the invention.
Figure 6:
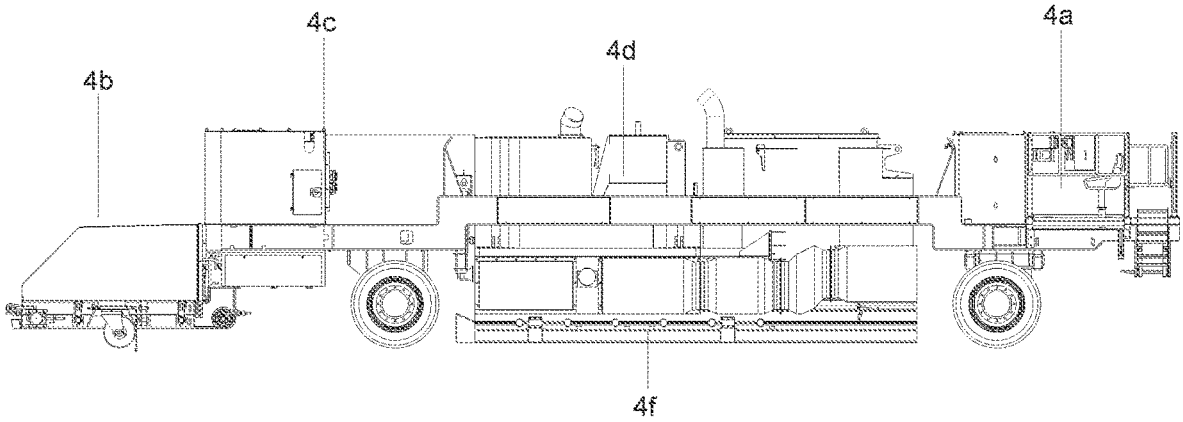
FIG. 6 is a structural diagram of a centralized hot mix heating unit according to the invention.

In these figures: 1. heating unit; 1*a*. heating console; 1*b*. fuel tank of the heating unit; 1*c*. hot blast stove; 1*c*1. burner of the heating unit; 1*c*2. exhaust funnel; 1*d*. fan of the heating unit; 1*e*. bellows of the heating unit; 2. milling unit; 2*a*. milling console; 2*b*. fuel tank of the milling unit; 2*c*. attemperator; 2*d*. heat preservation fan; 2*e*. thermal preservation bellows; 2*f*. milling mechanism; 3. dumper; 4. centralized hot mix heating unit; 4*a*. hot mix heating console; 4*b*. new material feeding hopper; 4*c*. fuel tank of the centralized hot mix heating unit; 4*d*. centralized hot mix heating device; 4*d*1. burner of the centralized hot mix heating unit; 4*e*. fan of the centralized hot mix heating unit; 4*f*. upender mechanism; 4*f*1. boot-shaped mixing paddle; 4*f*2. mixing structure with rollers and blades; 4*f*3. mixing structure with rotating shafts, mixing rods and the mixing blades; 5. mixing unit; 5*a*. feeding hopper; 5*b*. heat preservation device; 5*c*. lifting mechanism; 5*d*. weigh bin; 5*d*1. additive weighing device; 5*d*2. guide spiral rod; 5*d*3. baffle plate; 5*d*4. asphalt mixture; 5*d*5. receiving plate; 5*d*6. bin door; 5*e*. mixing tank; 6. compatible paving and compacting unit.

DETAILED DESCRIPTION OF THE EMBODIMENT

The invention will be described in more details below in combination with the figures and a specific embodiment:

The equipment train has unique mechanical design and structure with the following features: 1) Heating systems eliminate visible emission of fumes from heating through an organized process; 2) Simplified mechanical structure reduces difficulty in manufacture, operation and maintenance; 3) Mechanical mixing technique in the mixing unit achieves a uniform temperature increase of the hot mix material without damage; 4) Simultaneous metered feeding of required materials at multiple points and on-site mobile batch mixing ensure the correct grading of hot mix materials to be achieved.

A variety of damage of asphalt pavements can be repaired in an integrated manner. Old pavement materials and the fed required materials and additives are mixed, paved and rolled in situ by heating of hot air, hot milling, uniform hot mix heating and batch mixing technologies, so that the performance of asphalt pavements is fully restored. According to the concept of "clean production process, guaranteed recycling quality, and 100% high value-added utilization of old materials," relying on the five core competencies of "new heating mode, new heating principle, new design of hot mix heating, new mixing mode, and new intelligent system," the new hot-in-place asphalt recycling equipment train successfully realizes zero fume and dust overflow, centralized and harmless emission of waste gas during the construction. The production process and the quality of the mixture are comparable to those of plants, and recycled pavements are as reliable as new pavements in terms of performance and durability. The new hot-in-place asphalt recycling equipment train system not only lays a foundation for wide applications of recycled materials in practical projects, but also provides the optimum complete set of technologies for saving road materials and funds, avoiding environmental pollution, and realizing safe, fast, and eco-friendly road maintenance. This invention realizes centralized collection and treatment of the fume produced during heating process, and organized discharge of treated invisible fume. Comparing to the traditional hot-in-place unit, the invention provides cleaner construction process and better road quality with a simpler mechanical structure, which not only lowers manufacturing cost, but also reduces the complexity in operation, maintenance and repair.

As shown in FIGS. 1 to 12, a low-emission hot-in-place asphalt recycling equipment train system comprises at least three heating units 1, a milling unit 2, a centralized hot mix heating unit 4, a mixing unit 5, and compatible paving and compacting units 6. The heating unit 1 comprises a heating body, with a heating console 1*a*, a fuel tank 1*b*, a hot blast stove 1*c* and a fan 1*d* on the heating body and a bellows 1*e* installed at the bottom of the heating body. The hot blast stove 1*c* comprises an inner shell and an outer shell that are mutually inlaid; inside the inner shell is a combustion chamber, and a degradation chamber is formed between the inner shell and the outer shell; the burner of the heating unit 1*c*1 in the hot blast stove 1*c* extends into the combustion chamber. The air supply port of the combustion chamber is connected to one end of the bellows of the heating unit 1*e*, the air inlet of the fan of the heating unit 1*d* is connected to the other end of the bellows of the heating unit 1*e*, the air outlet of the fan of the heating unit 1*d* is connected to the degradation chamber, and the heating console 1*a* is connected to the hot blast stove 1*c* and the fan of the heating unit 1*d* through a circuit. The milling unit 2 comprises a milling body, with a milling console 2*a*, a fuel tank of the milling unit 2*b*, an attemperator 2*c* and heat preservation fan 2*d* installed on the milling body and a thermal preservation bellows 2*e* and a milling mechanism 2*f* arranged at the bottom of the milling body. The milling mechanism 2*f* comprises two rows of milling bit tools respectively located at the front and the back, with a fume collecting hood and a fume extractor equipped above the milling bit tools. The centralized hot mix heating unit 4 comprises a hot mix heating body, with a hot mix heating console 4*a*, a new material feeding hopper 4*b*, a fuel tank of the centralized hot mix heating unit 4*c*, a centralized hot mix heating device 4*d* and a fan of the centralized hot mix heating unit 4*e* installed on the hot mix heating body and an upender mechanism 4*f* arranged at the bottom of the hot mix heating body. A hot mix heating chamber is in the centralized hot mix heating unit 4*d*, with its top extending into the burner of the centralized hot mix heating unit 4*d*1 and its bottom connected to one end of the upender mechanism 4*f*; the air inlet of the fan of the hot mix heating unit 4*e* is connected to the other end of the upender mechanism 4*f*, and the air outlet of the fan of the hot mix heating unit 4*e* is connected to the hot mix heating chamber. The mixing unit 5 comprises a mixing body, which is equipped with a feeding hopper 5*a*, a heat preservation device 5*b*, a lifting mechanism 5*c*, a weighing bin 5*d*, and compatible paving and compacting unit. The inlet of the lifting mechanism 5*c* is connected to the heat preservation device 5*b*, the feeding end is connected to the weighing bin 5*d*, and the lower part of the weighing bin 5*d* is connected to the mixing tank 5*e*.

In this low-emission hot-in-place asphalt recycling equipment system, the following factors should be considered for the configuration of heating units 1: firstly, ensure the heating temperature of the old road surfaces can be controlled; secondly, ensure good economic benefits. In view of the aforesaid factors, generally three heating units 1 are needed. A folding thermal preservation board with certain unfolding and folding length is arranged at the tail of the heating body of each heating unit 1. The heating system of the milling unit 2 is the same as the heating system of the heating unit 1 in terms of basic principle and structure. In addition, the heating system of the milling unit 2 has the function of heating old road surfaces. Through the fume collecting hood and fume extractor which can stretch out and draw back with the milling bit tools, the fumes generated during milling can be collected and sent into the heating furnace for treatment. The hot mix heating system of the centralized hot mix heating unit 4 is the same as the heating system of the heating unit 1 in terms of basic principle and structure. The hot mix heating system of the centralized hot mix heating unit 4 uniformly raises the temperature of the mixture. The heat preservation system of the mixing unit 5 is the same as the heating system of the heating unit 1 in terms of basic principle and structure. The heat preservation system of the mixing unit 5 heats and maintains the temperature of the entire material stack. The mixing tanks 5*e* are batch mixers. The weighing bin 5*d* can accurately weigh the mixture in each tank and can simultaneously measure and feed various additives.

The bellows 1*e* of the heating unit comprises an air outlet area and a return air area; the air supply port of the combustion chamber is connected to the air outlet area, the air inlet of the fan of the heating unit 1*d* is connected to the return air area, and the bellows of the heating unit 1*e* has an open bottom.

An exhaust funnel 1*c*2 is installed at the top of the degradation chamber The milling bit tools are in a spiral shape and have flat edges. Bit tools with flat edges can mill pavements without causing damage and ensure that the gradations of pavement materials will not be affected. According to the principle of spiral distribution of milling bit tools, the loose old materials after milling can be collected at the tail to form a trapezoidal material stack.

A dust collector is arranged between the air outlet of the fan of the heating unit 4*e* and the hot mix heating chamber. The air inlet of the dust collector is connected to the air outlet of the fan of the heating unit 4*e*, and the air outlet of the dust collector is connected to the hot mix heating chamber. The fine particles of the flying materials in the return air can be removed by the dust collector, so as to realize fumeless and dust-free centralized heating. Moreover, there should be additives to select as well as the function of secondary pavement milling.

There are three schemes of the upender mechanism 4*f:*

Figure 7:
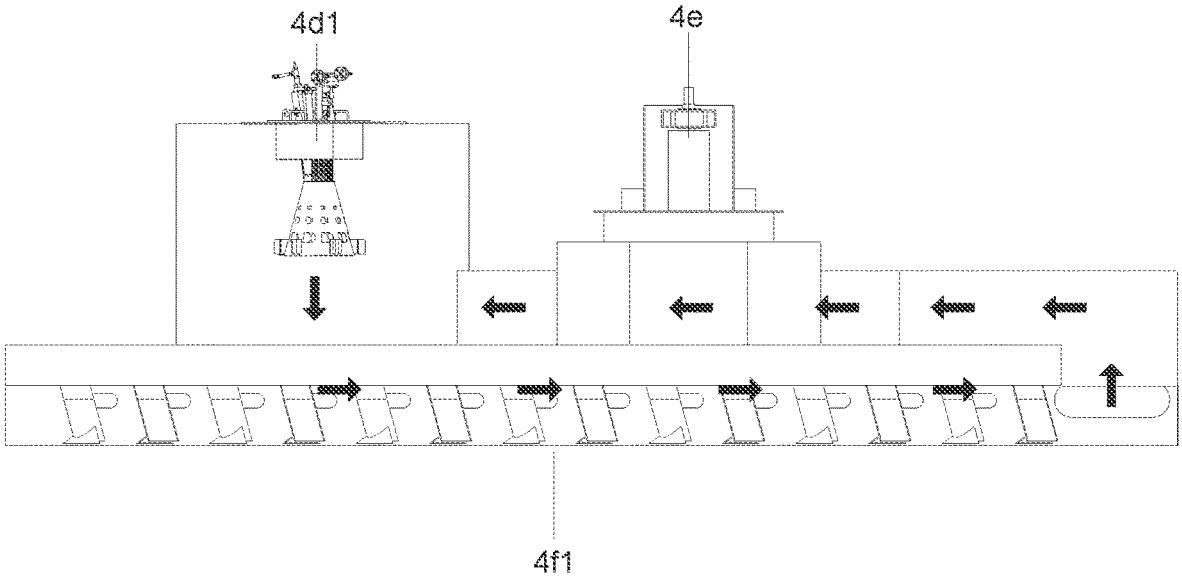
FIG. 7 is a structural diagram of scheme 1 of the upender of the centralized hot mix heating unit according to the invention.

As shown in FIG. 7, in scheme 1, the upender 4*f* comprises a shell, one end of the shell is a material inlet, and the other end is a material outlet; and a plurality of shoe-shaped mixing paddles 4*f*1 are evenly spaced in the shell along the same axis.

Figure 8:
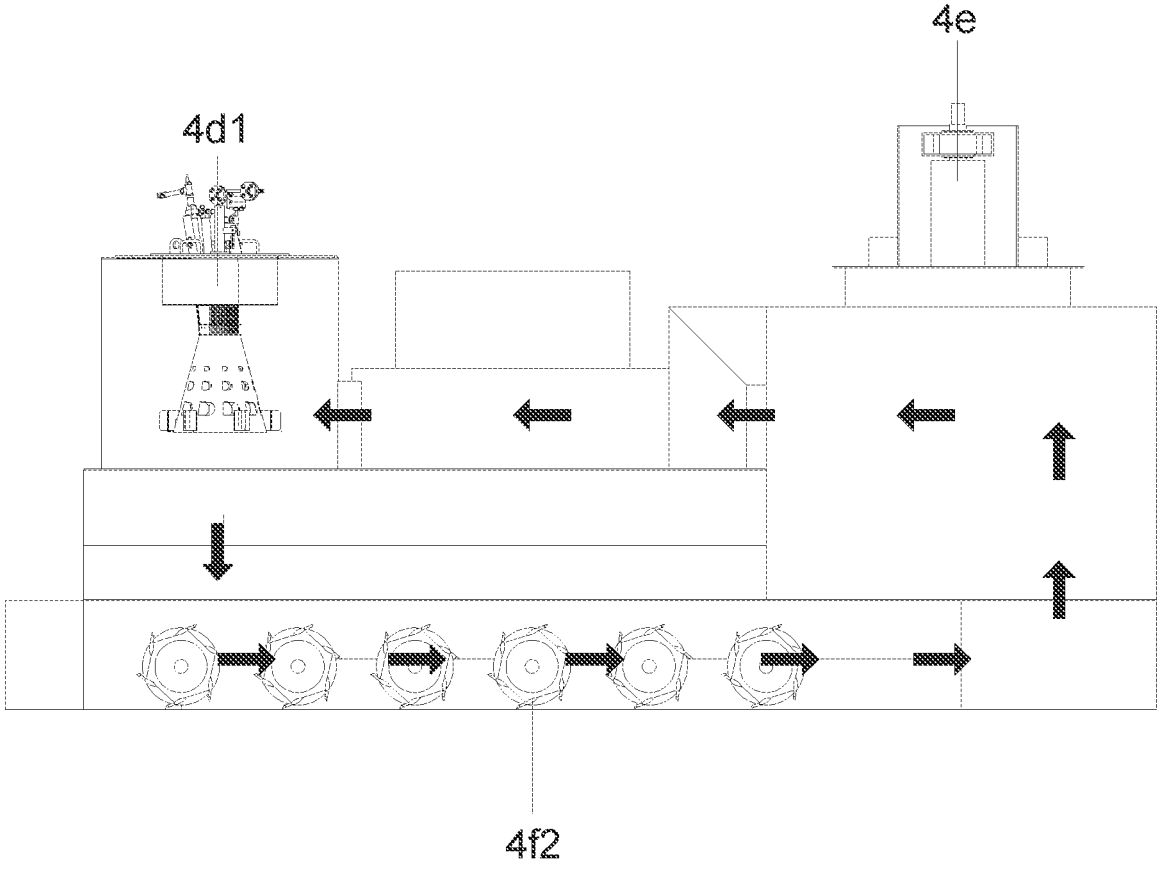
FIG. 8 is a structural diagram of scheme 2 of the upender of the centralized hot mix heating unit according to the invention.

As shown in FIG. 8, in scheme 2, the upender 4*f* comprises a shell, one end of the shell is a material inlet, and the other end is a material outlet; and a plurality of rollers are evenly spaced in the shell along the same horizontal line to coordinate with the turning structure 4*f*2 of the semi-blades.

Figure 9:
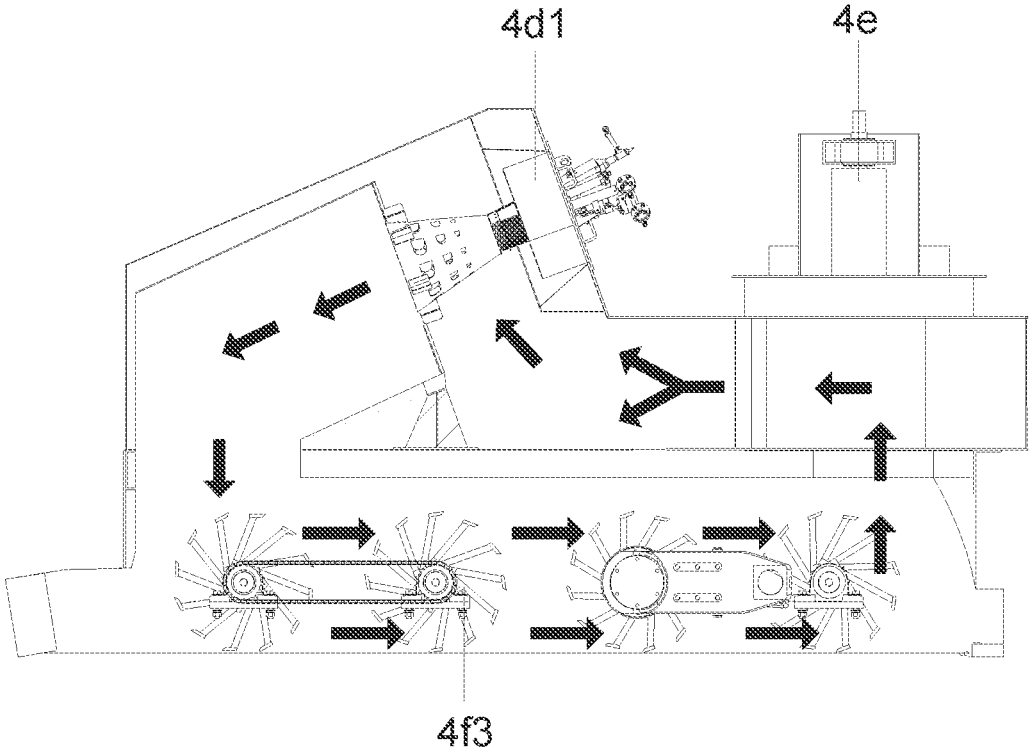
FIG. 9 is a structural diagram of scheme 3 of the upender of the centralized hot mix heating unit according to the invention.
Figure 10:
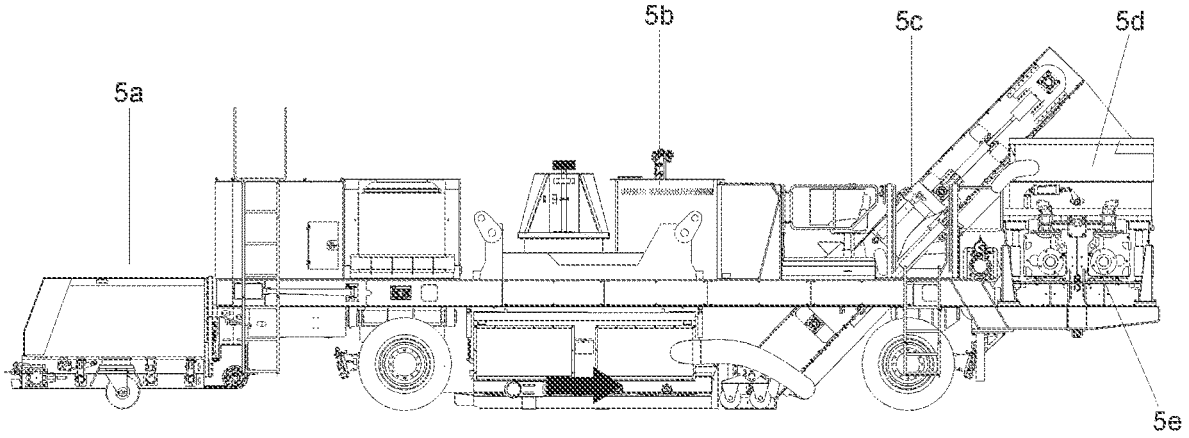
FIG. 10 is a structural diagram of the mixing unit according to the invention.
Figure 11:
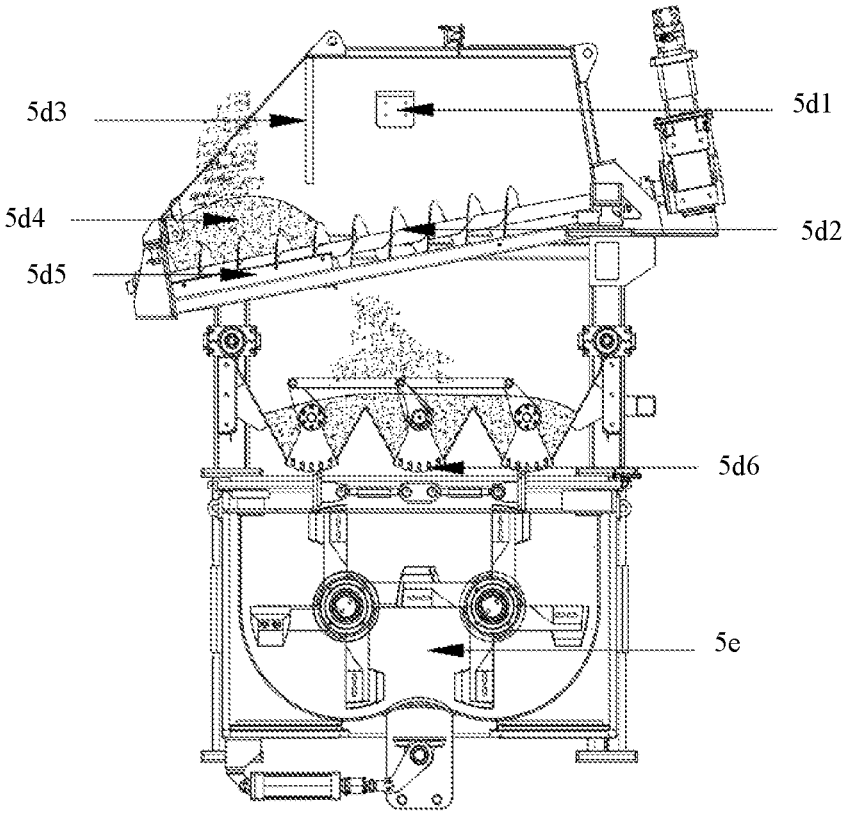
FIG. 11 is a weighing state diagram of the weighing bin and the mixing tanks in the mixing unit according to the invention.
Figure 12:
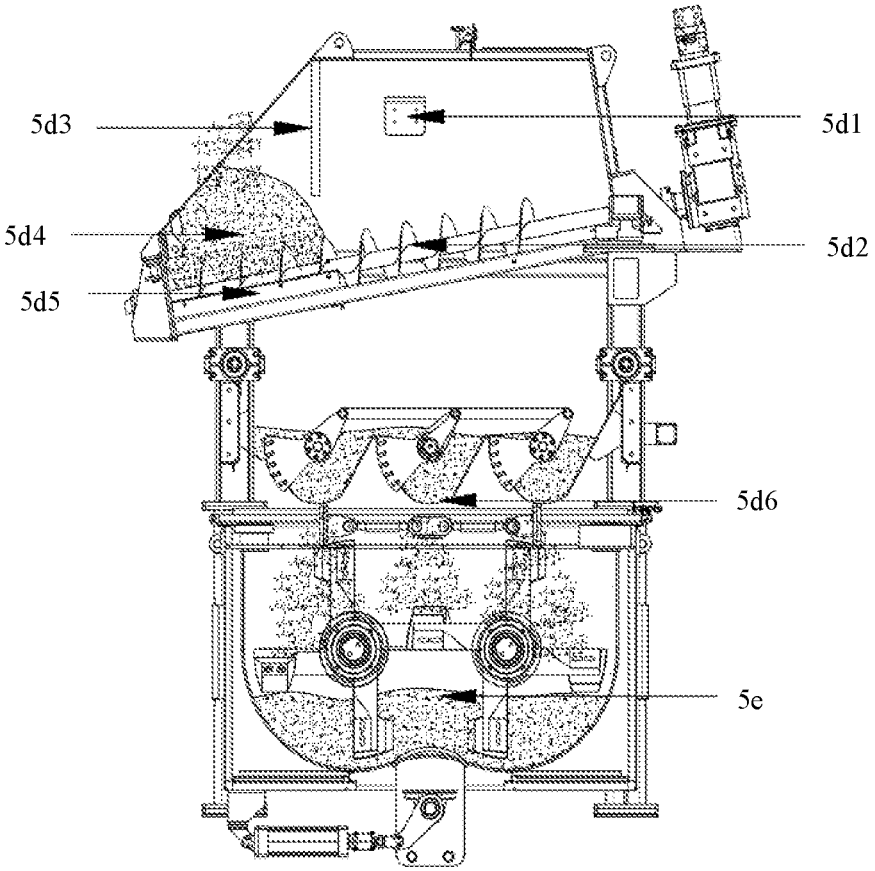
FIG. 12 is a diagram of feeding by the weighing bin and the mix tanks in the mixing unit according to the invention.

As shown in FIG. 9, in scheme 3, the upender 4*f* comprises a shell, one end of the shell is a material inlet, and the other end of the shell is a material outlet; and a plurality of rotating shafts are evenly spaced in the shell along the same horizontal line to coordinate with the turning structures 4*f*3 of turning rods and turning blades.

All the three turning structures can turn up the materials to form a curtain, increasing the contact area between hot air and materials and improving heat exchange.

Four spiral rods for material conveying 5*d*2 are arranged longitudinally in the weighing bin 5*d*, baffle plates 5*d*3 are arranged above the spiral rods for material conveying 5*d*2, and receiving plates 5*d*5 are arranged below the spiral rods for material conveying 5*d*2. An additive weighing device 5*d*1 is arranged at the top of the weighing bin 5*d*, and a plurality of bin doors 5*d*6 are arranged at the bottom of the weighing bin 5*d*. The built-in device for weighing and metering recycled materials and additives that is used for the mixing unit 5 is a weighing bin 5*d* suspended on a four-point weighing sensor. The weighing sensor has lateral buffer compensation and can send high-frequency weighing signals to the controller. The upender mechanism is suitable for in-vehicle application when the recycling construction vehicle is at low speed.

At least one mixing paddle is provided in the mixing tank 5*e*. With the mixing paddle in the mixing tank 5*e*, all asphalt mixture is mixed in a vortex in the mixing tank 5*e*. Intense chemical reaction of asphalt mixture will happen. Mixing for a long time maximizes the effect of the additives, and then asphalt rejuvenators can fully and evenly recycle the old asphalt. Sufficient mixing time ensures the homogeneity of the recycled asphalt mixture. The mixing quality is comparable to that of mixing stations used in plants.

For using the method of hot-in-place asphalt recycling construction, the equipment train should comprise at least three heating units 1, a milling unit 2, a centralized hot mix heating unit 4, a mixing unit 5, and compatible paving and compacting units 6. The specific steps of the method are as follows:

1) Heat the old pavement in a stepwise, fumeless manner with a plurality of heating units 1. After the first heating unit 1 finishes heating, control the road surface temperature at 90-110° C.; after the second heating unit 1 finishes heating, control the pavement surface temperature at 130-160° C.; after the third heating unit 1 finishes heating, control the pavement surface temperature at 170-180° C. to completely soften the asphalt layer. Always pay attention to the air temperature in the bellows of the heating unit 1*e* to prevent uneven heating of the road surface caused by changes in air temperature. When the wind force is at level 3-5, reduce the distance between the bellows of the heating unit 1*e* and the old road surface to ensure efficient heating of the old road surface by hot air. Keep the distance between the bellows of the heating unit 1*e* and the old road surface equal or above the minimum value to ensure sufficient supply of return air. When the wind force is higher than level 5, stop the heating construction;

Heat the air with the burner of the heating unit 1*c*1. Jet impingement heat transfer can be done by utilizing the temperature difference of at least 500° C. between the hot air and the road surface. Driven by the fan of the heating unit 1*d*, the hot air transfer heats at high speed and under high pressure in the construction region formed by the bellows of the heating unit 1*e* and the road surface. Asphalt fumes produced by heating asphalt pavement are decomposed under the high temperature for an average of more than 1s. Driven by the fan of the heating unit 1*d*, more than 70% of the decomposed fumes return to the bellows of the heating unit 1*e*, and turn into high-temperature air after being reheated by flame, so that the saving of hot air heat energy is realized. The rest of the harmless fumes (less than 30%) are discharged in an eco-friendly manner, and oxygen-containing fresh air is supplemented through gaps around the construction zone. That is, no hot fumes are emitted from the construction region, oxygen is supplemented for combustion, and heat energy saving is realized;

It takes at least 20 minutes for the hot air in the heating unit 1 to raise the average temperature of the 5 cm section of the old road surface from 10° C. to above 120° C. High-speed and high-temperature jet impingement flow of the hot air from the air outlet impacts the road surface. The heat transfer coefficient is high in the impacted region. Moreover, the greater the temperature difference, the better the heat exchange effect. When the speed of jet impingement flow is 20 m/s and length of j et impingement flow is 10 cm, 550° C. is the optimum temperature of hot air. After heating at a speed of 2.0-4.0 m/min, the temperature of the road surface does not exceed 185° C., and the temperature of the section 5 cm below the surface is above 85° C. That is, the required heating intensity for jet impingements flow is reached, the temperature is maintained to give sufficient time for heat transfer downward by the asphalt mixture, and finally the section reaches the temperature required for milling.

The road surface heated by the heating unit 1 is 10-15 mm wider than the surface milled on both sides. The effective thermal connection of longitudinal joints can be ensured by widening the heating width by 10-15 mm.

When multiple heating units 1 heat the old road surface, it takes some time for the downward heat transfer. Spacing between adjacent heating units 1 is reserved. Rapid heat loss will be caused if the old road surface between adjacent heating units is not exposed to the natural environment. Unfold the thermal preservation board at the tail of each heating unit 1 to maintain the temperature of the road surfaces between adjacent heating units, and adjust the length of the thermal preservation boards according to the spacing to ensure the heating effect to the greatest extent.

2) Before milling, the attemperator 2*c*, the thermal preservation bellows 2*e* and the heat preservation fan 2*d* on the milling unit 2 keep the old road surface at a suitable temperature for milling. The milling unit 2 mills and collects the heated loose asphalt mixture on the old road surface without causing damage, collects the fumes generated during milling in a centralized manner for high-temperature decomposition, and then forms the milled asphalt mixture into a trapezoidal material stack;

For milling adjacent paved road surfaces, the region for milling shall be 10-15 mm wider than that of the paved road surfaces to ensure longitudinal thermal connection and consistent appearance.

Check the road surface temperature at the milled edges at all times. If the temperature is low, adjust the air temperature of the heating units 1 and the milling unit 2 in time to ensure that the milled edges are at the required temperature and that the longitudinal joints join closely together. The bottom surface of the milled layer should be of the required roughness and controlled at 70-90° C., and the temperature of the material stack formed after milling should not lower than 100° C.

The milling unit 2 keeps the temperature of the milled old road surface equal to the temperature of the old road surface heated by the last heating unit 1, and adjusts the air temperature of the attemperator 2*c* of the milling unit 2 in time according to the temperature change of the old road surface before milling. The milling depth is controlled intelligently. The milling unit 2 can automatically control the milling depth. However, since the milling depth often changes, the milling depth should be measured at all times and adjusted in time when changes occur to ensure uniform milling depth.

3) The dumper 3 unloads the new asphalt mixture into the new material feeding hopper 4*b* of the centralized hot mix heating unit 4. The unloading angle of the dumper 3 shall be adjusted and controlled according to the remaining mixture amount in the new material feeding hopper 4*b* and the construction speed, so as to ensure that the supply of the required new asphalt mixture is sufficient and uninterrupted and that the said mixture does not overflow. The amount of new asphalt mixture changes synchronously with the change of vehicle speed. When the vehicle stops due to a fault, stop feeding new asphalt mixture immediately. The asphalt content of the new asphalt mixture should be consistent with that of the original pavement after heating and milling, so as to ensure the accuracy of additive metering and addition during subsequent mixing. Feed the milled and collected material stack into the centralized hot mix heating unit 4 to mix with the new asphalt mixture. The new and old asphalt mixtures in the centralized hot mix heating unit 4 are thrown up by the upender 4*f*, forming a curtain of granular materials suspended in the hot mix heating chamber. Fumeless hot air is generated by the centralized hot mix heating unit 4*d* and the fan of the centralized hot mix heating unit 4*e*. The mixture of new and old asphalt is subjected to saturated secondary centralized heating to raise the temperature by 30-50° C., This design can solve the problem of uneven heating at sections of the pavement, enable the new and old materials to be fully mixed and maintain temperature uniformity, effectively compensate the heat loss of the materials due to exposure to the environment, and raise the temperature of new and old asphalt mixture from 120° C. to 150° C. under the conditions of the vehicle speed of 4-6 m/min and the production capacity of 100-120 t/h, thus ensuring the construction temperature required for recycling and paving;

When the speed of the centralized hot mix heating unit 4 is 4 m/min, the rotation speed of the upender 4*f* is not less than 100-120 revolutions per minute. The rotation speed can be appropriately adjusted according to the specific material stack generated by recycling width and depth. The hot air temperature is automatically controlled by real-time detection, with the temperature of the heated new and old asphalt mixtures (150° C.) as the reference. The hot air temperature is adjusted between 160° C. and 240° C. When the mixture of new and old asphalt is lower than 150° C., the hot air temperature is increased, when the temperature of the mixture of new and old asphalt is higher than 150° C., the hot air temperature will be reduced and finally balanced to ensure that the temperature of the recycled asphalt mixture reaches 150° C. during paving.

Asphalt fumes and some dust enter the air duct along with the return air under the action of the fan of the heating unit 4*e*. The return air duct is provided with a plurality of corners and dust collection structures. Dust is deposited in the dust collector when the air speed is reduced, and asphalt fumes enter the combustion furnace along with the return air for combustion. The asphalt fumes are effectively decomposed, and the after-heat of the hot air is utilized to achieve the dual purposes of energy conservation and environmental protection.

Collecting the material stack in the centralized hot mix heating unit 4 is a required process. The amount of material stack fed into the centralized hot mix heating unit is proportionate to the length of the hot mix heating system. There is a very low probability that an excessive amount of asphalt mixture is in the centralized hot mix heating unit 4. In this case, appropriately increase the speed of the upender 4*f* to quickly discharge the asphalt mixture in the centralized hot mix heating unit 4 through the outlet to ensure the turning and heating effect.

4) Feed the uniformly blended mixture of new and old asphalt into the heat preservation device 5*b* of the mixing unit 5, and maintain the temperature of the asphalt mixture 5*d*4 above 150° C. The lifting mechanism 5*c* receives and lifts the asphalt mixture 5*d*4 into the weighing bin 5*d*. After being accurately weighed by the weighing bin 5*d*, the asphalt mixture 5*d*4 and the additives are put into the mixing tank 5*e* together. Stir the asphalt mixture 5*d*4 and the additives for at least 40 s. All asphalt mixture 5*d*4 is subjected to 3D vortex mixing. Intense chemical reaction of asphalt mixture 5*d*4 will happen. Mixing for a long time maximizes the effect of the additives, and then asphalt rejuvenators can fully and evenly recycle the old asphalt, thus generating recycled asphalt with a temperature of not lower than 150° C. and ensuring a paving temperature of not lower than 130° C. During construction, infrared thermometers should be used to detect the temperature of the generated recycled asphalt. If the temperature is lower than 150° C., appropriately increase the air temperature of the heat preservation device and the centralized hot mix heating unit 4*d*. Due to the stable weighing of asphalt mixture 5*d*4, the accurate additive amount, and the sufficient mixing time, the quality of recycled asphalt mixture 5*d*4 is homogeneous. The mixing quality is comparable to that of mixing stations used in plants.

The chain scraper of the lifting mechanism 5*c* sends the asphalt mixture 5*d*4 to the weighing bin 5*d* at the top. Then the asphalt mixture 5*d*4 is pushed into the weighing bin 5*d* by four longitudinally arranged spiral rods for material conveying 5*d*2. At the same time, the additive weighing device 5*d*1 at the top of the weighing bin 5*d* starts weighing according to the required weight and feeds a corresponding amount of additives. When the asphalt mixture 5*d*4 in the weighing bin 5*d* reaches the preset weight, the four material spiral rods for material conveying 5*d*2 will stop running, and the bin doors 5*d*6 at the bottom of the weighing bin 5*d* will be opened to feed the weighed asphalt mixture **5*d*4 and the additives into the mixing tank 5*e*. The bin doors 5*d*6 at the bottom of the weighing bin 5*d* will be closed after the feeding is completed, the four material spiral rods for material conveying 5*d*2** will restart to convey materials, and the weighing bin will restart to weigh materials.

When the bin doors **5*d*6 are closed, the materials are fed into the weighing bin 5*d* for weighing. When the doors 5*d*6 are opened, the materials are fed into the mixing tank 5*e* from the weighing bin 5*d*, and the batch mixing of the mixing tank 5*e* is realized at intervals when the bin doors 5*d*6 are opened and closed. When the lifting mechanism 5*c* lifts the asphalt mixture 5*d*4 from the ground to the weighing bin 5*d*, there is sufficient time for batch mixing in the mixing tank 5*e*. A certain amount of asphalt mixture 5*d*4 and the additives are fully mixed in the mixing tank 5*e***, so that the uniformity of the mixture can be realized.

The additives at least comprise pavement additives such as asphalt rejuvenators, durable agent, and fiber anti-rut agent. A plurality of additives can be fed simultaneously according to actual needs, and the addition amount is automatically controlled according to the weight of the asphalt mixture **5*d*4; The asphalt rejuvenator is sprayed in the weighing bin 5*d*, and then permeates into the asphalt mixture 5*d*4 during mixing. The use of rejuvenator ensures the uniformity of the recycled asphalt mixture 5*d*4**.

5) The recycled asphalt is fed into the material receiving hopper of the compatible paving and compacting units 6 through the material outlet of the mixing tank **5*e* of the mixing unit 5. The compatible paving and compacting units 6 uniformly convey the recycled asphalt material into the screed plate through the material spiral rods for material conveying, and pave the recycled asphalt material on the road surface. During paving operation, use an infrared thermometer to detect the paving temperature. Ensure that the paving temperature is not lower than 130° C. When the temperature does not comply with the requirement, it is indicated that the automatic temperature control system of the recycling unit has a fault. Manually increase or decrease the air heating temperature of the heating unit 1 and the centralized hot mix heating unit 4**;

6) For the initial rolling on the recycled road surface, a dual-drive dual-vibration road roller with the vibration function disabled closely follows the compatible paving and compacting unit 6 and performs high-temperature rolling. The temperature of the initial rolling should not lower than 130° C. Adjacent rolling zones should have an overlap of 10-20 cm. The roller completes a cycle after it goes to the end of the road and back, and 2 cycles are required for the initial rolling. No displacement or cracking is allowed;

For the re-rolling on the recycled road surface, enable the vibration function of the dual-drive dual-vibration roller. Adjacent rolling zones should have an overlap of ⅓ of the wheel width. The rolling speed should be 2-4 km/h. After two cycles of rolling, another 3-4 cycles should be completed by a rubber-tired roller until the specified compactness is reached;

For the final rolling on the recycled road surface, 1-2 cycles should be completed by a double-steel wheel roller, and the temperature of the recycled road surface after rolling should not be lower than 65° C.;

7) When the temperature of the recycled road surface is reduced to below 50° C., the traffic can be resumed.

The theoretical basis of fumeless heating of the low-emission hot-in-place asphalt recycling equipment train system is that the volume of the overflowing gas in the construction zone formed by the bellows of the heating unit and the ground is equal to the product of the area of the gaps around the construction zone and the inlet air flow rate of 2 m/s. The air flows into the gaps around the construction zone. There is no fume overflow, but only air intake.

A variety of damage of asphalt pavements can be repaired in an integrated manner. Old pavement materials and the fed required materials and additives are mixed, paved and rolled in situ by heating of hot air, hot milling, uniform hot mix heating and batch mixing technologies, so that the performance of asphalt pavements is fully restored. According to the concept of "clean production process, guaranteed recycling quality, and 100% high value-added utilization of old materials," relying on the five core competencies of "new heating mode, new heating principle, new design of hot mix heating, new mixing mode, and new intelligent system," the new hot-in-place asphalt recycling equipment train successfully realizes zero fume and dust overflow, centralized and harmless emission of waste gas during the construction. The production process and the quality of the mixture are comparable to those of plants, and recycled pavements are as reliable as new pavements in terms of performance and durability. The new hot-in-place asphalt recycling equipment train system not only lays a foundation for wide applications of recycled materials in practical projects, but also provides the optimum complete set of technologies for saving road materials and funds, avoiding environmental pollution, and realizing safe, fast, and eco-friendly road maintenance. This invention realizes centralized collection and treatment of the fume produced during heating process, and organized discharge of treated invisible fume. Comparing to the traditional hot-in-place unit, the invention provides cleaner construction process and better road quality with a simpler mechanical structure, which not only lowers manufacturing cost, but also reduces the complexity in operation, maintenance and repair.

The above description is certainly not intended to limit the invention, nor is the invention limited to the above examples. Changes, modifications, supplements, or substitutions made by those skilled in the art within the substantive scope of the invention should be included in the protection scope of the invention.

The invention claimed is:

1. A low-emission hot-in-place asphalt recycling equipment train system, wherein at least three heating units, a milling unit, a centralized hot mix heating unit, a mixing unit, and compatible paving and compacting units are included;

the heating unit comprises a heating body, with a heating console, a fuel tank, a hot air blast stove and a fan installed on the heating body and a heating system arranged at the bottom of the heating body;

the hot blast stove comprises an inner shell and an outer shell that are mutually inlaid;

inside the inner shell is a combustion chamber, and a degradation chamber is formed between the inner shell and the outer shell;

a burner in the hot blast stove extends into the combustion chamber;

an air supply port of the combustion chamber is connected to one end of a bellows of the heating system, an air inlet of the fan of the heating unit is connected to the other end of the bellows, the air outlet of the fan of the heating unit is connected to the degradation chamber, and the heating console is connected to the hot blast stove and the fan of the heating unit through a circuit;

the milling unit comprises a milling body, with a hot mix heating console, a fuel tank, a burner and a fan installed on the hot mix heating body and a bellows and a milling mechanism arranged at the bottom of the hot mix heating body;

the milling mechanism comprises two rows of milling bit tools respectively located at a front and a back of the milling mechanism, with a fume collecting hood and a fume extractor installed above the milling bit tools;

the centralized hot mix heating unit comprises a hot mix heating body, with a hot mix heating console, a new material feeding hopper, a fuel tank, a hot blast stove and a fan installed on the hot mix heating body and an upender arranged at the bottom of the hot mix heating body;

a hot mix heating chamber is in the centralized hot mix heating unit, with its top extending into the burner and its bottom connected to one end of the upender;

the air inlet of the fan installed on the hot mix heating unit is connected to the other end of the upender, and the air outlet of the fan installed on the hot mix heating unit is connected to the hot mix heating chamber;

the mixing unit comprises a mixing body, with a new material feeding hopper, a heater, a lifting mechanism, a weighing bin and a mixer installed on the mixing body;

the inlet of the lifting mechanism is connected to the heat preservation device, the feeding end is connected to the weighing bin, and the lower part of the weighing bin is connected to the mixer.

2. The low-emission hot-in-place asphalt recycling equipment train system according to claim 1, wherein the bellows of the heating unit comprises an air outlet area and a return air area;

the air supply port of the combustion chamber is connected to the air outlet area, the air inlet of the fan of the heating unit is connected to the return air area, and the bellows of the heating unit has an open bottom.

3. The low-emission hot-in-place asphalt recycling equipment train system according to claim 1, wherein an exhaust funnel is installed at the top of the degradation chamber.

4. The low-emission hot-in-place asphalt recycling equipment train system according to claim 1, wherein the milling bit tools are in a spiral shape and have flat edges.

5. The low-emission hot-in-place asphalt recycling equipment train system according to claim 1, wherein a dust collector is arranged between the air outlet of the fan of the heating unit and the hot mix heating chamber;

the air inlet of the dust collector is connected to the air outlet of the fan of the heating unit, and the air outlet of the dust collector is connected to the hot mix heating chamber.

6. The low-emission hot-in-place asphalt recycling equipment train system according to claim 1, wherein the upender comprises a shell;

one end of the shell is a material inlet, and the other end of the shell is a material outlet; and a plurality of boot-shaped mixing paddles are evenly spaced in the shell along the same axis.

7. The low-emission hot-in-place asphalt recycling equipment train system according to claim 1, wherein the upender comprises a shell;

one end of the shell is a material inlet, and the other end of the shell is a material outlet; and a plurality of rollers are evenly spaced in the shell along the same horizontal line to coordinate with the turning structure of the semi-blades.

8. The low-emission hot-in-place asphalt recycling equipment train system according to claim 1, wherein the upender comprises a shell;

one end of the shell is a material inlet, and the other end of the shell is a material outlet; and a plurality of rotating shafts are evenly spaced in the shell along the same horizontal line to coordinate with the turning structures of turning rods and turning blades.

9. The low-emission hot-in-place asphalt recycling equipment train system according to claim 1, wherein four spiral rods for material conveying are arranged longitudinally in the weighing bin;

baffle plates are arranged above the spiral rods for material conveying, and receiving plates are arranged below the spiral rods for material conveying;

an additive weighing device is at the top of the weighing bin, and a plurality of doors are at the bottom of the weighing bin.

10. The low-emission hot-in-place asphalt recycling equipment train system according to claim 1, wherein at least one mixing paddle is provided in each mixing tank, which is a mobile batch mixer.

11. The low-emission hot-in-place asphalt recycling equipment train system according to claim 1, wherein each heating system achieves centralized collection and treatment of the fume produced during heating process, and organized discharge of treated invisible fume.

* * * * *